US008011607B1

(12) United States Patent
Rossi, Jr.

(10) Patent No.: US 8,011,607 B1
(45) Date of Patent: Sep. 6, 2011

(54) SIZE AND METAL SEPARATOR FOR MOBILE CRUSHER ASSEMBLIES

(76) Inventor: Robert R. Rossi, Jr., Charlotte, NC (US)

( * ) Notice: Subject to any disclaimer, the term of this patent is extended or adjusted under 35 U.S.C. 154(b) by 716 days.

(21) Appl. No.: 11/877,945

(22) Filed: Oct. 24, 2007

Related U.S. Application Data

(60) Provisional application No. 60/854,053, filed on Oct. 24, 2006.

(51) Int. Cl.
*B02C 1/02* (2006.01)

(52) U.S. Cl. ..... 241/69; 241/101.2; 241/101.73; 241/266

(58) Field of Classification Search ..... 241/69, 241/73, 101.72, 101.73, 264, 79.1, 101.2, 241/265, 266
See application file for complete search history.

(56) References Cited

U.S. PATENT DOCUMENTS

| | | | | |
|---|---|---|---|---|
| 3,802,631 | A * | 4/1974 | Boyd | 241/20 |
| 3,814,336 | A * | 6/1974 | Brewer | 241/79.1 |
| 3,927,839 | A * | 12/1975 | Quinn | 241/76 |
| 4,361,289 | A | 11/1982 | Georget et al. | |
| 4,607,799 | A | 8/1986 | Currie | |
| 5,199,666 | A * | 4/1993 | Williams | 241/73 |
| 5,402,948 | A * | 4/1995 | Kaczmarek | 241/73 |
| 5,601,239 | A * | 2/1997 | Smith et al. | 241/29 |
| 5,749,530 | A | 5/1998 | Nakayama et al. | |
| 5,863,003 | A * | 1/1999 | Smith | 241/73 |
| 5,908,165 | A * | 6/1999 | Guschall et al. | 241/23 |
| 5,915,636 | A * | 6/1999 | Caballero | 241/73 |
| 5,975,443 | A * | 11/1999 | Hundt et al. | 241/27 |
| 6,027,056 | A * | 2/2000 | Maciejewski et al. | 241/62 |
| 6,076,753 | A * | 6/2000 | Maciejewski et al. | 241/62 |
| 6,739,532 | B2 * | 5/2004 | McCamley | 241/24.14 |
| 6,871,807 | B2 | 3/2005 | Rossi, Jr. | |
| 6,915,972 | B2 | 7/2005 | Rossi, Jr. | |
| 2003/0189116 | A1 * | 10/2003 | McCamley | 241/24.19 |
| 2004/0050984 | A1 * | 3/2004 | Rossi, Jr. | 241/101.72 |
| 2005/0263631 | A1 * | 12/2005 | Kitsukawa et al. | 241/101.72 |

FOREIGN PATENT DOCUMENTS

| | | |
|---|---|---|
| WO | WO 2004/026478 A3 | 4/2004 |
| WO | WO 2004/026479 A1 | 4/2004 |

* cited by examiner

*Primary Examiner* — Faye Francis
(74) *Attorney, Agent, or Firm* — Dority & Manning, P.A.

(57) ABSTRACT

A mobile bucket assembly for crushing objects includes a frame configured as a bucket that can carry a screen and/or a magnet. The mobile bucket assembly can be attached to a piece of construction equipment such as a front end loader or an excavator for example.

16 Claims, 20 Drawing Sheets

SIZE AND METAL SEPARATOR FOR MOBILE CRUSHER ASSEMBLIES

CROSS-REFERENCE TO RELATED APPLICATIONS

N/A

FEDERALLY SPONSORED RESEARCH OR DEVELOPMENT

N/A

BACKGROUND

Mobile jaw crusher assemblies are shown in U.S. Pat. No. 6,915,972, which is hereby incorporated herein in its entirety for all purposes. Mobile impact crusher assemblies are shown in U.S. Pat. No. 6,871,807 which is hereby incorporated herein in its entirety for all purposes.

Jaw crushers and impact crushers are machines that typically are stationed at construction sites such as where buildings are being demolished or roads are being built or repaired. The crushers are used to reduce rubble or other materials from a larger to a smaller size. Material from these constructions sites may be placed into the crusher, crushed into a suitable size by the crusher and a further processing machine, and then reused at this particular construction site. This allows for a quick, inexpensive supply of needed materials along with the reduction of waste to the environment.

An impact crusher is a device that typically includes a frame that defines an enclosure wherein material that is to be crushed is dropped vertically into the frame. A rotor is rotationally mounted within the frame and turns about a horizontal axis. The rotor is often provided with one or more crushing bars that contact the material that is dropped into the frame. The crushing bars impact the material and force the material against either a wall of the frame or against one or more impact plates that are positioned within the frame. The material is crushed into smaller objects by being thrown against these impact plates and is moved into a different section of the frame. Here, the materials again may be contacted by a crushing bar of the rotor and thrown against one or more impact plates to further reduce the size of the crushed material. Eventually, the material is discharged from the frame and is deposited either into a pile or onto a conveyor system that transports the crushed objects to be further processed.

A typical jaw crusher includes a generally V-shaped crushing space that is formed between two crushing plates. Typically, one of these plates is a fixed plate while the other plate is movable. It is common for the movable plate to communicate with an eccentric shaft and for rotation of the eccentric shaft to cause a corresponding movement of the movable plate. Material is placed into the upper portion of the crushing space. This material, for instance a stone, is then crushed between the two crushing plates by relative movement of the crushing plates. The broken material then falls due to gravity into a subsequently narrower portion of the crushing space and is likewise reduced in size. Upon exiting the crushing space from the jaw crusher, the material is reduced to a size smaller than that when previously inserted.

A typical jaw crusher or impact crusher uses a diesel/hydraulic system in order to operate. It is often the case that other pieces of machinery that work in conjunction with the crusher also have their own diesel/hydraulic systems.

A jaw crusher or an impact crusher can crush materials that contain steel, which sometimes can be separated from the surrounding material when that material is crushed.

BRIEF SUMMARY

At the level of a general overview, it can be said that the present invention improves upon previous mobile jaw crushers and mobile impact crushers. In some of the illustrated embodiments, this improvement can be accomplished by providing for a screen attached to the crusher's bucket and/or a magnet attached to the crusher's bucket, which can be attached to a piece of construction equipment such as a front end loader for example or an excavator for example. Vibrating and/or orienting the screen can be implemented in a number of ways, including so as to generate at least two separate flows determined by the size of the material exiting the outlet of the bucket. Provision also can be made for removing metal attracted to the magnet.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

BRIEF DESCRIPTION OF THE DRAWINGS

FIG. 6C is an exploded side plan view of the circled detail of an embodiment of a magnet 25 shown in FIG. 6B.

DETAILED DESCRIPTION OF EMBODIMENTS OF THE INVENTION

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the disclosed embodiments of the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
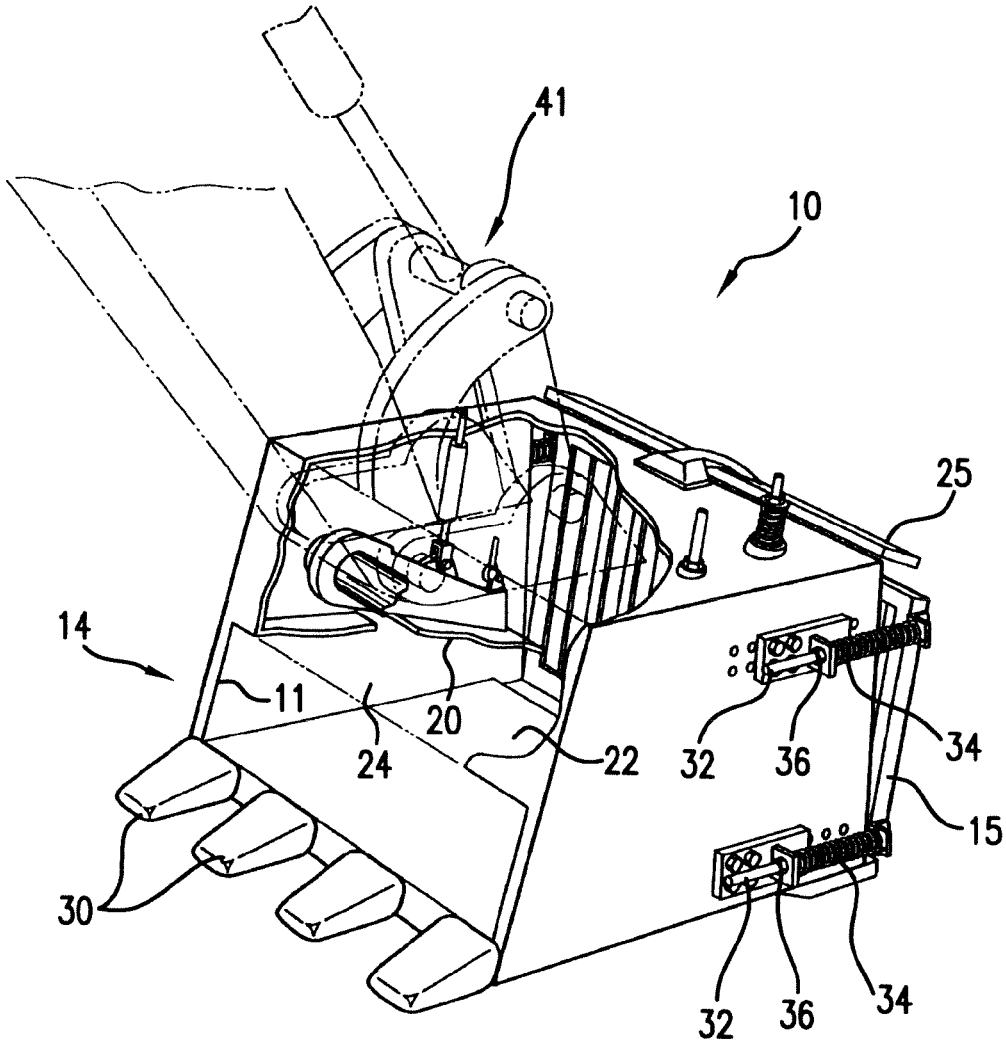
FIG. 1 is a side elevation view of an exemplary embodiment of a mobile excavator bucket 14 outfitted with a jaw crusher assembly and an embodiment of a screen 15 and an embodiment of a magnet 25 in accordance with the present invention with linkages to the excavator shown in chain-dashed line.
Figure 2:
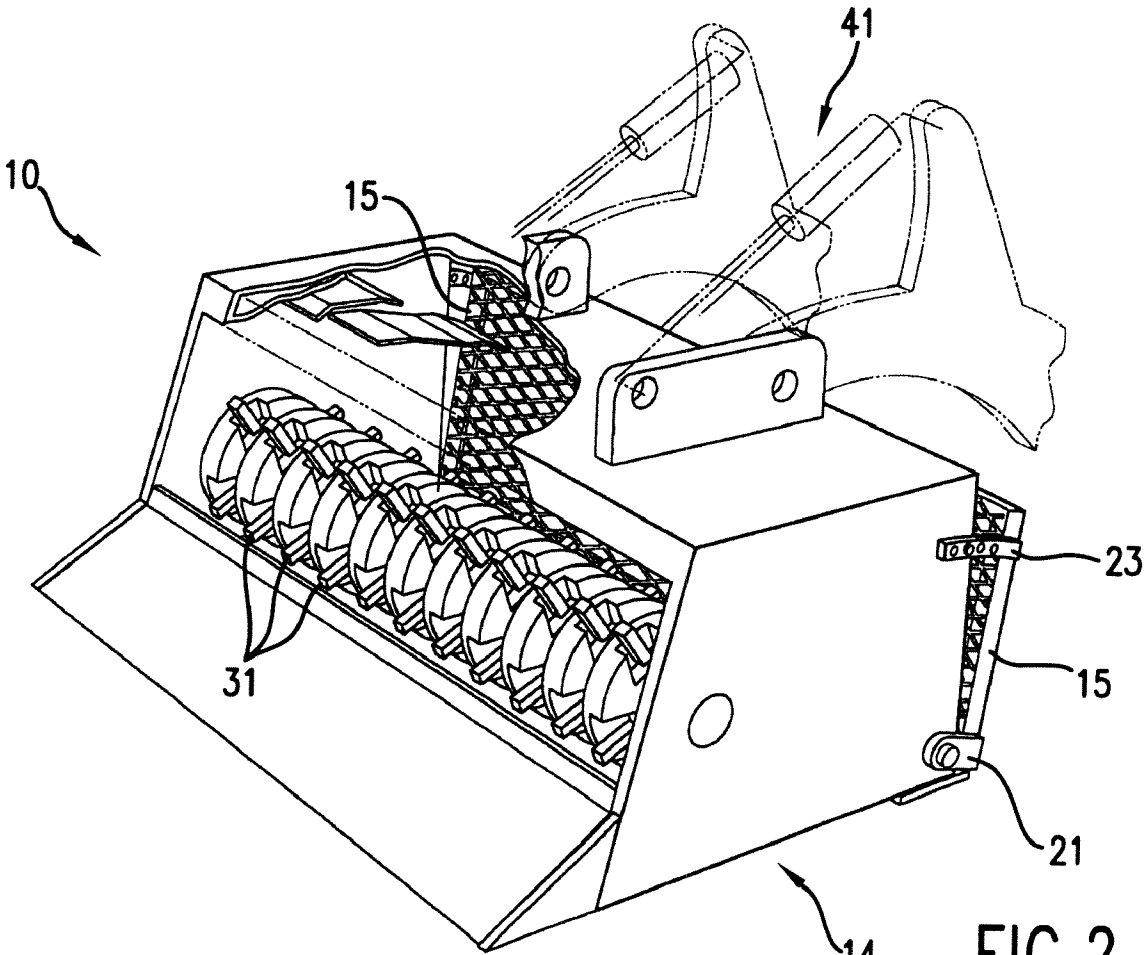
FIG. 2 is a side elevation view of an exemplary embodiment of a mobile front-end loader bucket 14 outfitted with an impact crusher assembly and an embodiment of a screen 15 in accordance with the present invention with linkages to the front-end loader shown in chain-dashed line.
Figure 5:
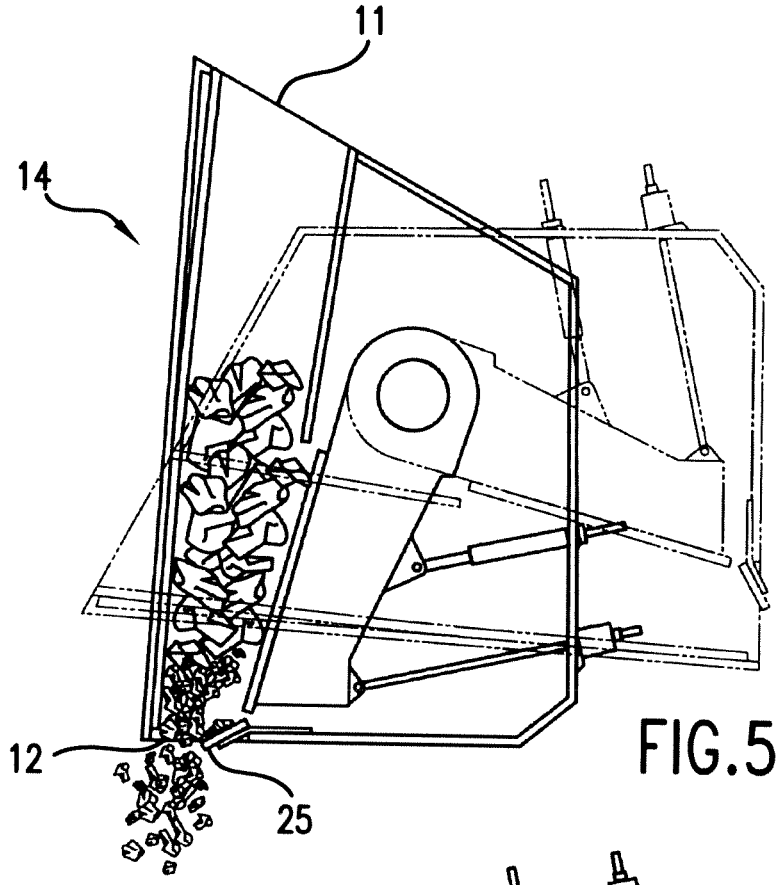
FIG. 5 is a side plan view of an exemplary embodiment of a mobile front-end loader bucket 14 with the side removed to permit viewing the jaw crusher assembly inside the bucket 14 and an embodiment of a magnet 25 in accordance with the present invention with the bucket 14 disposed in a crushing orientation and with the scooping orientation of the bucket 14 shown in chain-dashed line. The solid line drawing shows objects being passed through and crushed by the mobile jaw crusher assembly.

FIG. 1 shows an exemplary embodiment of a mobile bucket assembly 10 outfitted with an embodiment of a screen 15 in accordance with one exemplary embodiment of the present invention and an embodiment of a magnet 25 in accordance with one exemplary embodiment of the present invention. As shown in FIG. 2 for example, some embodiments of the invention contemplate using just a screen 15 without a magnet. As shown in FIG. 5 for example, other embodiments of the invention contemplate using just a magnet 25 without a screen.

As embodied herein and shown in the Figs., a mobile bucket assembly 10 for crushing objects can comprise a frame 14 that is configured for attachment to a vehicle that is capable of moving the mobile bucket assembly. As schematically indicated by the chain-dashed line outline generally designated by the numeral 41 in FIGS. 1-4 and 7, the frame of the bucket assembly 10 can be configured with a connection member 41 that allows for the attachment of the assembly 10 to a vehicle (not shown). The connection member 41 may be for instance a bolted connection, or may be a welded or an interlocking connection.

It is to be understood that the mobile bucket assembly 10 may be configured to be attachable to various types of vehicles, which may be self-propelled. For instance, the mobile bucket assembly 10 may be configured to be attached to any of various vehicles, including but not limited to the following vehicles: a hydraulic excavator, a shovel, and/or a crane. One such vehicle can be a front end loader, an example of which being illustrated in FIG. 6 of U.S. Pat. No. 6,915,972. Another such vehicle can be an excavator, an example of which being illustrated in FIG. 6 of U.S. Pat. No. 6,871,807. As such, the mobile bucket assembly 10 of the present invention is not limited to attachment, or configuration to be attached, to a particular type of vehicle.

The connection member 41 may be a quick disconnect member such that the mobile bucket assembly 10 can be easily and quickly connected to and from a vehicle. Alternatively, the connection member 41 may also be a permanent type connection wherein the mobile bucket assembly 10 is permanently affixed to the vehicle. As such, the mobile bucket assembly 10 is not limited to a particular type of connection member 41.

As embodied herein and shown in the Figs., the frame of the mobile bucket assembly 10 for crushing objects can define a bucket 14. As shown in FIGS. 1-6B, 6D-7 and 9B for example, the bucket 14 has an inlet 11 through which material that is to be crushed is permitted to enter the bucket 14.

Figure 6A:
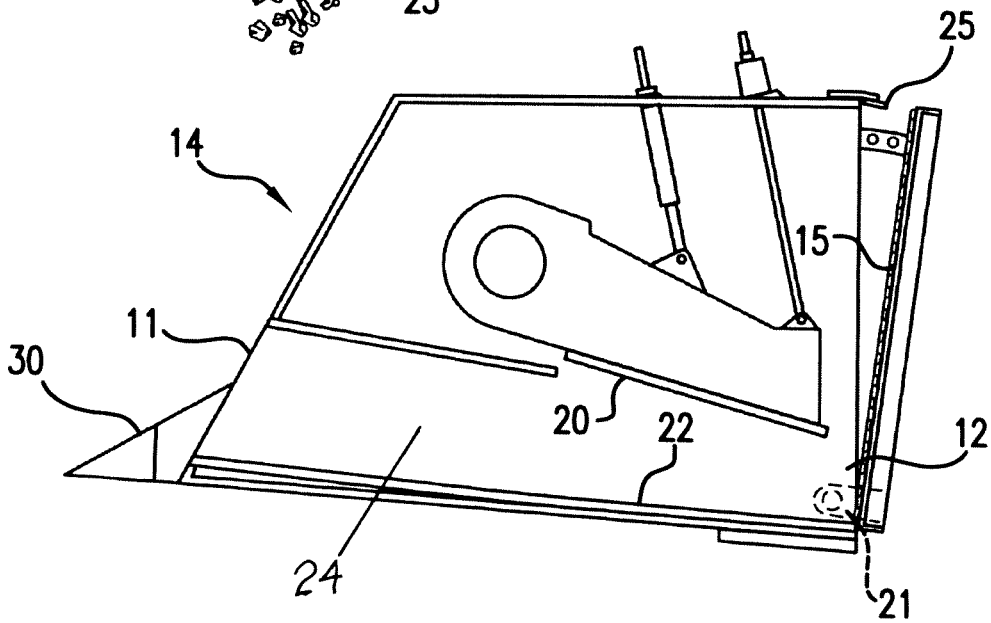
FIG. 6A is a side plan view of an exemplary embodiment of a mobile excavator bucket 14 with the side removed to permit viewing the jaw crusher assembly inside the bucket 14 and an embodiment of a screen 15 and an embodiment of a magnet 25 in accordance with the present invention with the bucket 14 disposed in a scooping orientation and the external pivoting connection of the screen 15 to the far side wall of the bucket 14 shown in chain-dashed line.

As shown in FIGS. 1 and 6A for example, the bucket 14 may move forward such that material to be crushed is urged through an inlet opening 11 of the bucket 14 into the interior 24 of the mobile bucket assembly 10. Teeth 30 may be present on the frame 14 near the inlet opening 11 in order to assist in digging objects or placing material into the interior 24. As such, a vehicle may manipulate the mobile bucket assembly 10 so that the objects and/or material are/is both torn from a pile and/or loaded into the interior 24 of the mobile bucket assembly 10.

The mobile bucket assembly 10 is outfitted with a crushing assembly that is carried by the frame. The crushing assembly includes a crushing element that is disposed within the bucket 14. The crushing element is configured to be selectively moveable to crush and break up material that enters through the inlet of the bucket 14.

The configuration of the crushing assembly of an embodiment of a mobile bucket assembly 10 can include as a crushing element, a first crushing member 20. As in one possible exemplary embodiment shown in FIG. 9B, the first crushing member 20 can include a moveable jaw 20 of a jaw crusher, and the crushing assembly can include a second crushing member 22 that faces the first crushing member 20, a crushing chamber 26 being defined therebetween. It is known in the art to configure jaw crushers such that a "V" shaped arrangement is defined by a side view of a pair of crushing members. U.S. Pat. No. 5,749,530 by Nakayama and U.S. Pat. No. 4,361,289 by Georget provide examples of different ways of configuring a jaw crusher, these two patents being incorporated by reference into the present application in their entirety for all purposes. Alternatively, as shown in FIG. 2, the crushing element can include one or a plurality of rotors 31 of an impact crusher.

As shown in FIG. 1, where part of the front wall defining the input opening 11 of the bucket defined by a frame 14 has been cut away to reveal its internally disposed components, the first crushing member 20 and the second crushing member 22 are arranged such that one may be moved relative to the other. Here the second crushing member 22 is attached and fixed relative to the frame 14 and in fact forms one of the interior surfaces of the bucket 14 that defines the crushing chamber 26. The first crushing member 20 is movable with respect to the frame 14 and the second crushing member 22.

Figure 6B:
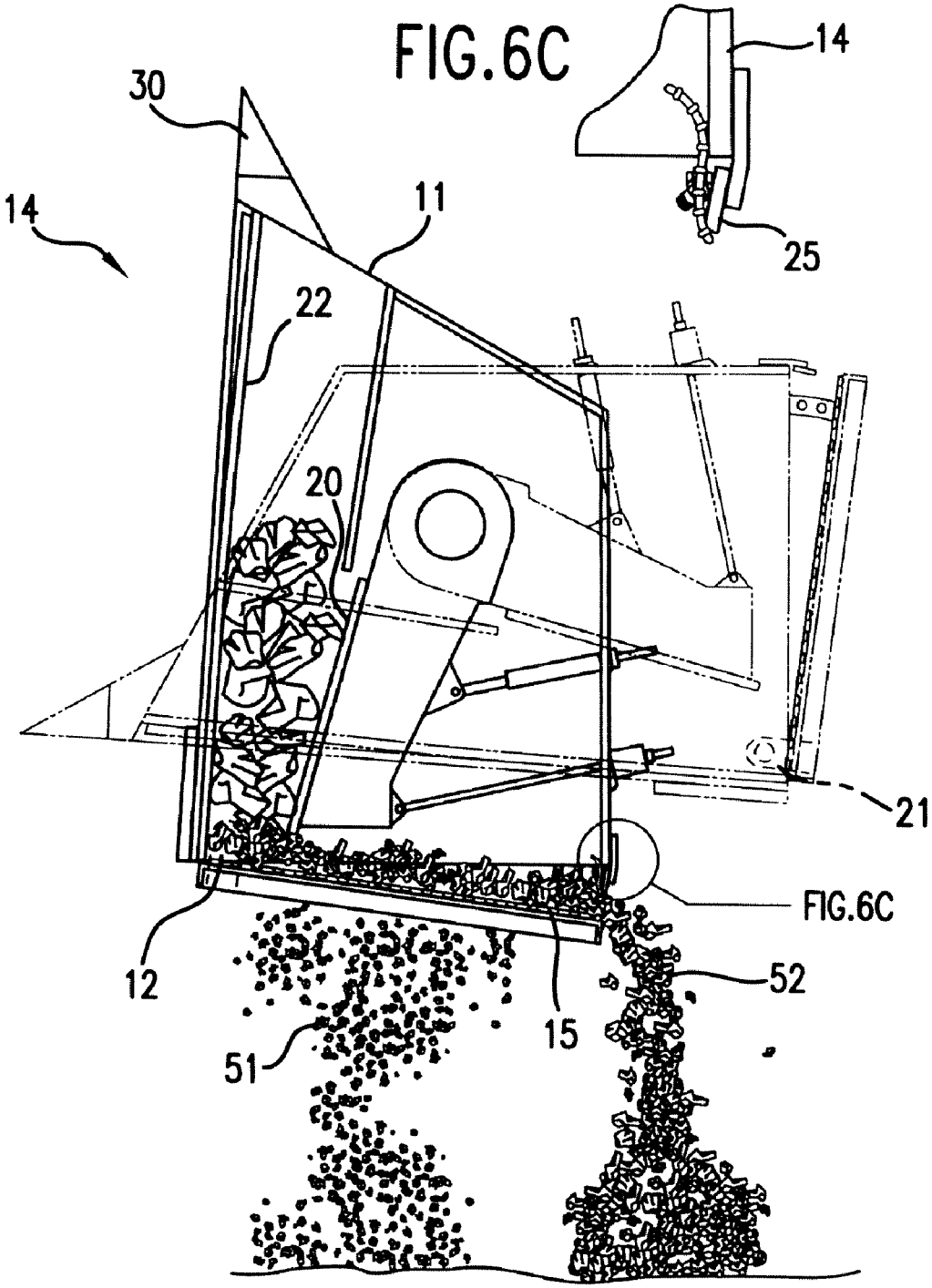
FIG. 6B is a side plan view of an exemplary embodiment of a mobile excavator bucket 14 with the side removed to permit viewing the jaw crusher assembly inside the bucket 14 and an embodiment of a screen 15 and an embodiment of a magnet 25 in accordance with the present invention with the bucket 14 disposed in a crushing orientation and with the scooping orientation of the bucket 14 shown in chain-dashed line. The solid line drawing shows objects being passed through and crushed by the mobile jaw crusher assembly.
Figure 6D:
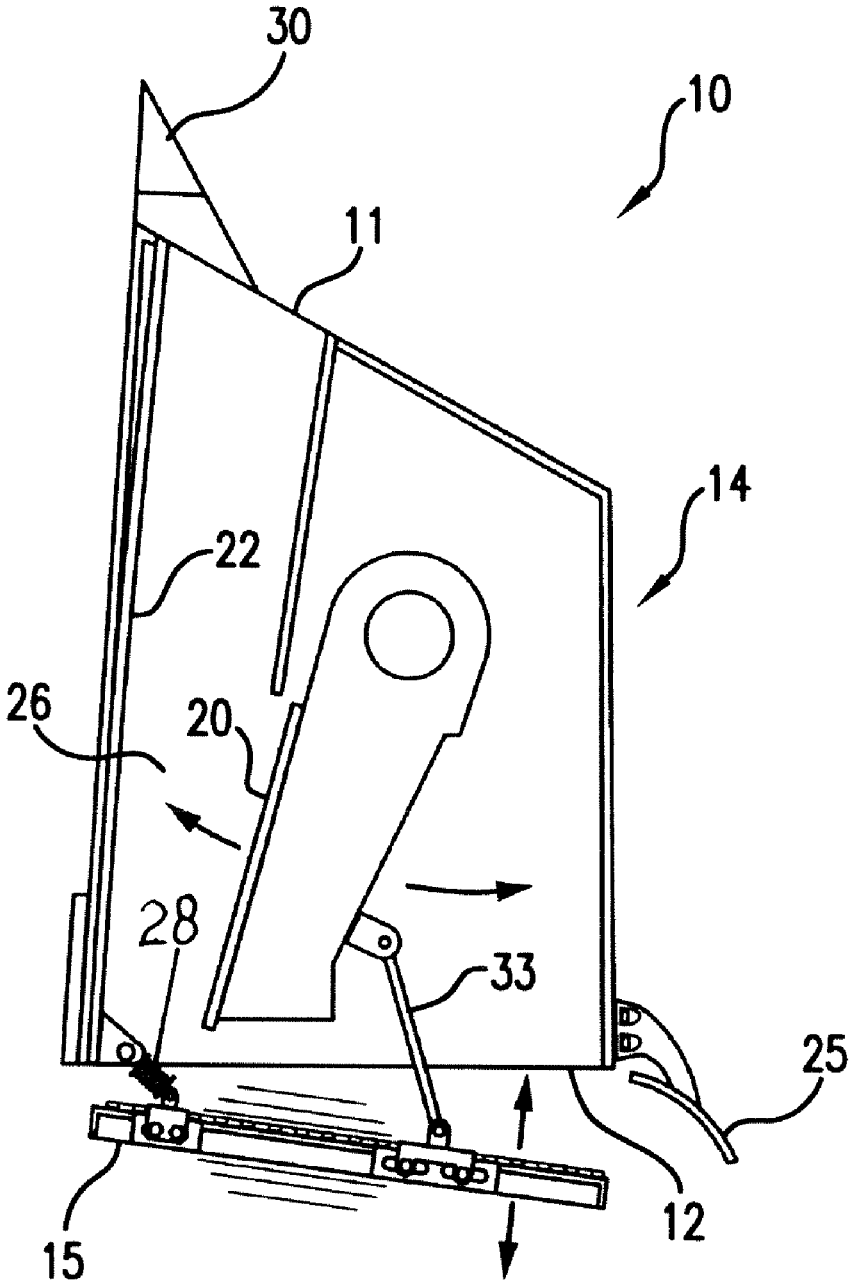
FIG. 6D is a side plan view of an exemplary embodiment of a mobile excavator bucket 14 with the side removed to permit viewing the jaw crusher assembly inside the bucket 14 and an embodiment of a screen 15 and an embodiment of a magnet 25 in accordance with the present invention with the bucket 14 disposed in a crushing orientation and with the crushing movement of the moving jaw indicated by the slightly arced shafts of the arrows and the corresponding vibratory motion of the screen 15 indicated by the vertically oriented shafts of the arrows and the lines parallel to and above and below the screen 15.
Figure 6E:
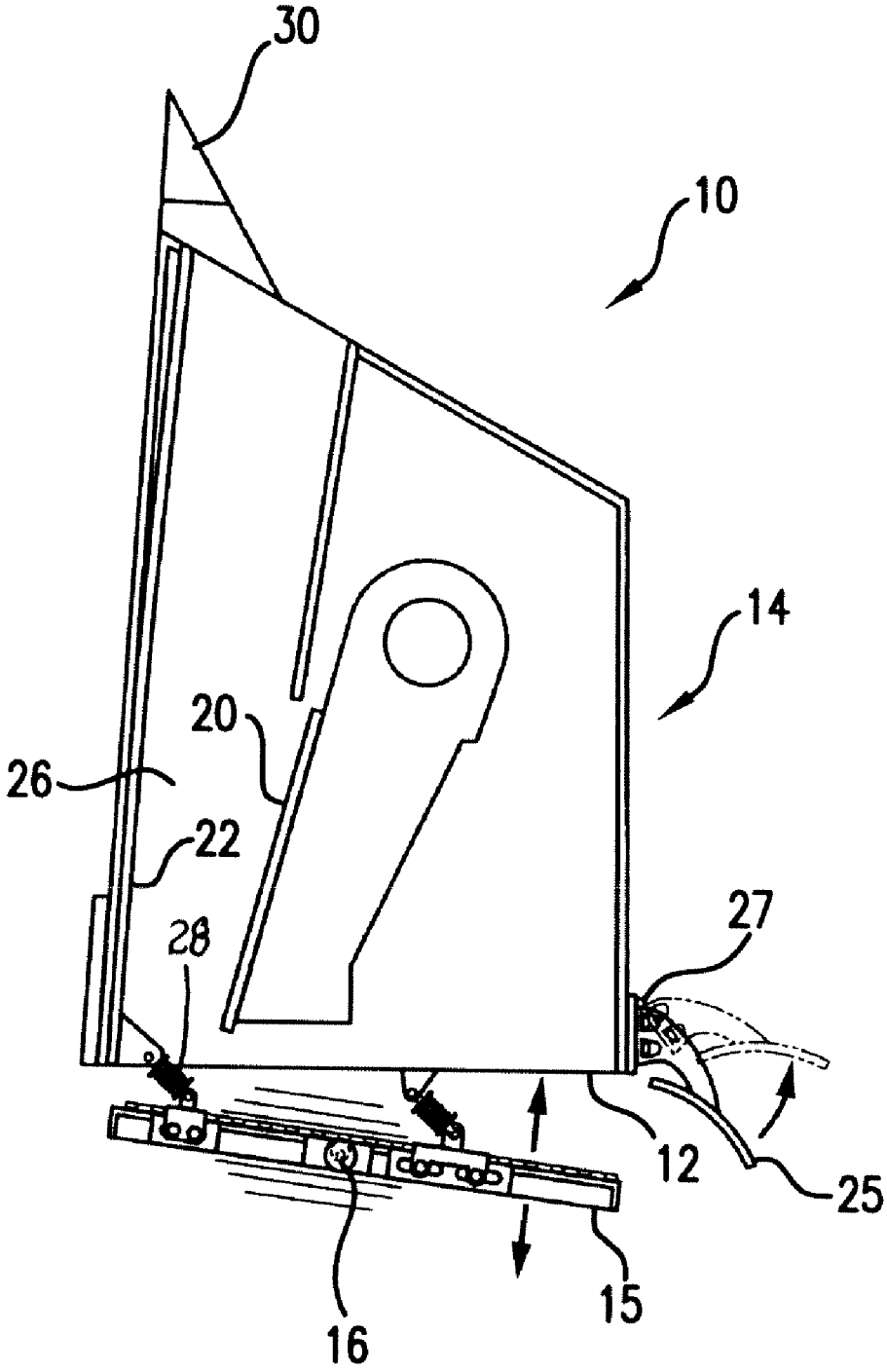
FIG. 6E is a side plan view of another exemplary embodiment of a mobile excavator bucket 14 with the side removed to permit viewing the jaw crusher assembly inside the bucket 14 and another embodiment of a screen 15 and another embodiment of a magnet 25 in accordance with the present invention with the bucket 14 disposed in a crushing orientation and with the vibratory motion of the screen 15 indicated by the vertically oriented shafts of the arrows and the lines parallel to and above and below the screen 15. The chain-dashed line drawing of the magnet assembly shows it pivoting in a way as would occur if the bucket 14 were to be rested on the ground.

As shown in FIGS. 6D and 6E for example, the bucket 14 has an outlet 12 that can be disposed downstream from the inlet 11 and from the crushing assembly.

In accordance with an embodiment of the present invention, the mobile bucket assembly can include a screen carried by the frame and configured to be selectively positioned to intercept objects exiting through the outlet of the bucket. Desirably, the screen can be made of non-magnetic elements such as stainless steel or a composite resin. As shown in FIGS. 1-4, 6A and 6D-7 for example, the screen 15 can be attached to the exterior of the bucket 14. As shown in FIGS. 9A and 9C-9F for example, the screen 15 can be attached to the interior of the bucket 14.

Rather than acting merely as a grate that either allows or denies passage of materials, the screen 15 is desirably configured and disposed to function as a separator that allows passage of materials having elements with at least two differently sized profiles. As shown in FIG. 6B for example, the screen 15 is configured and disposed to provide at least two distinct pathways that separate the incoming mass into two output masses, 51, 52. Each output mass 51, 52 is characterized by elements that have a distinctly different maximum and minimum size. For example, the minimum size of the elements in output mass 52 is larger than the maximum size of the elements in output mass 51.

Figure 7:
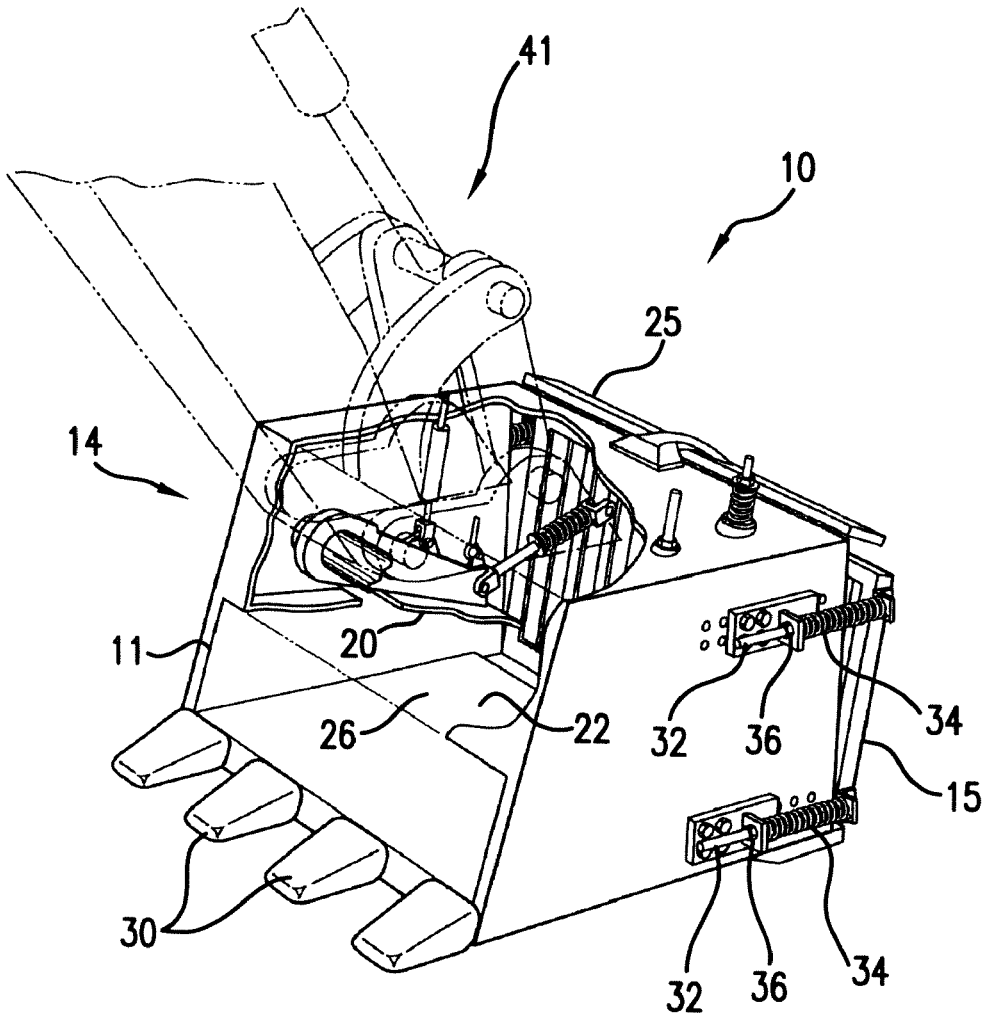
FIG. 7 is a side elevation view of an exemplary embodiment of a mobile excavator bucket 14 outfitted with a jaw crusher assembly with an embodiment of a magnet 25 similar to the one shown in FIG. 1 in accordance with the present invention but with another embodiment of a screen 15 with a vibratory linkage attached to the moving jaw 20 and with linkages to the excavator shown in chain-dashed line.
Figure 8A:
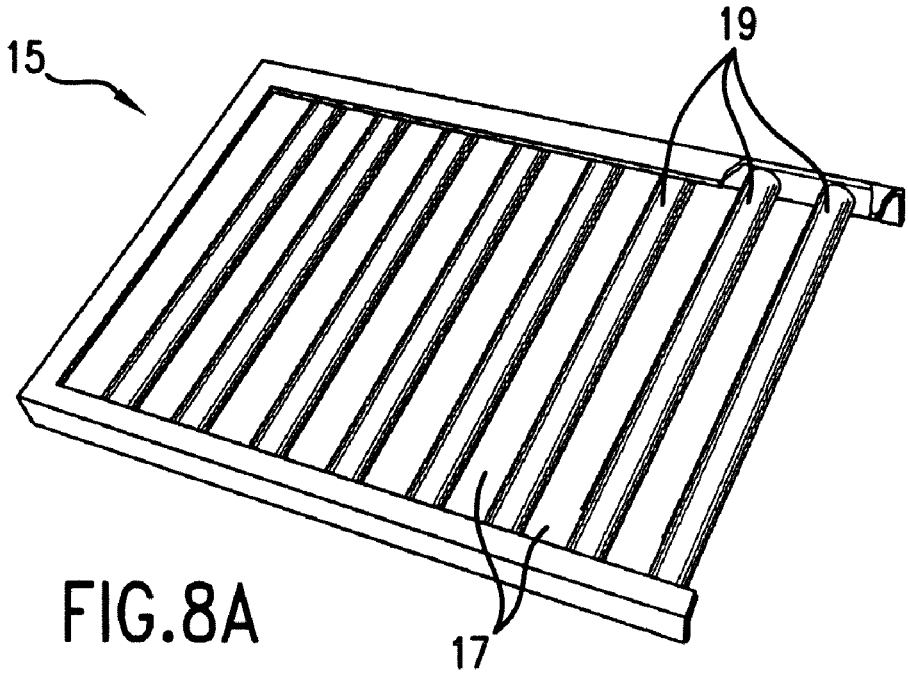
FIG. 8A is a top elevation view of an exemplary embodiment of a screen 15 mechanism that could be used in accordance with the present invention.
Figure 8B:
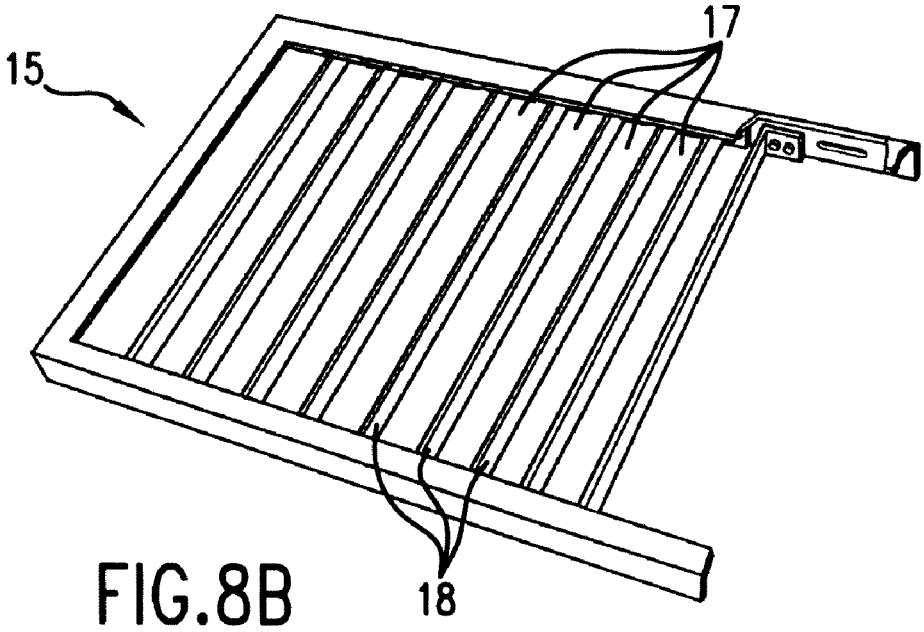
FIG. 8B is a top elevation view of another exemplary embodiment of a screen mechanism that could be used in accordance with the present invention.

The screen 15 can have any of a number of possible configurations. All possible screen media can be fitted to form the screen 15 herein. The screen elements can be formed of alternating slots and rectangular slats. The screen elements can be formed of alternating spaces 17 and bars 18 as shown in FIGS. 1, 4, 7 and 8B. The screen elements can be formed of diamond shaped openings in a wire mesh mounted on a peripheral support as shown in FIG. 2. The screen elements can be formed of rectangular-shaped openings in a wire mesh mounted on a peripheral support as shown in FIGS. 3, 9A, 9B and 9F. The screen elements can be formed of alternating spaces 17 and cylinders or cylindrical rollers 19 as shown in FIG. 8A.

Figure 9A:
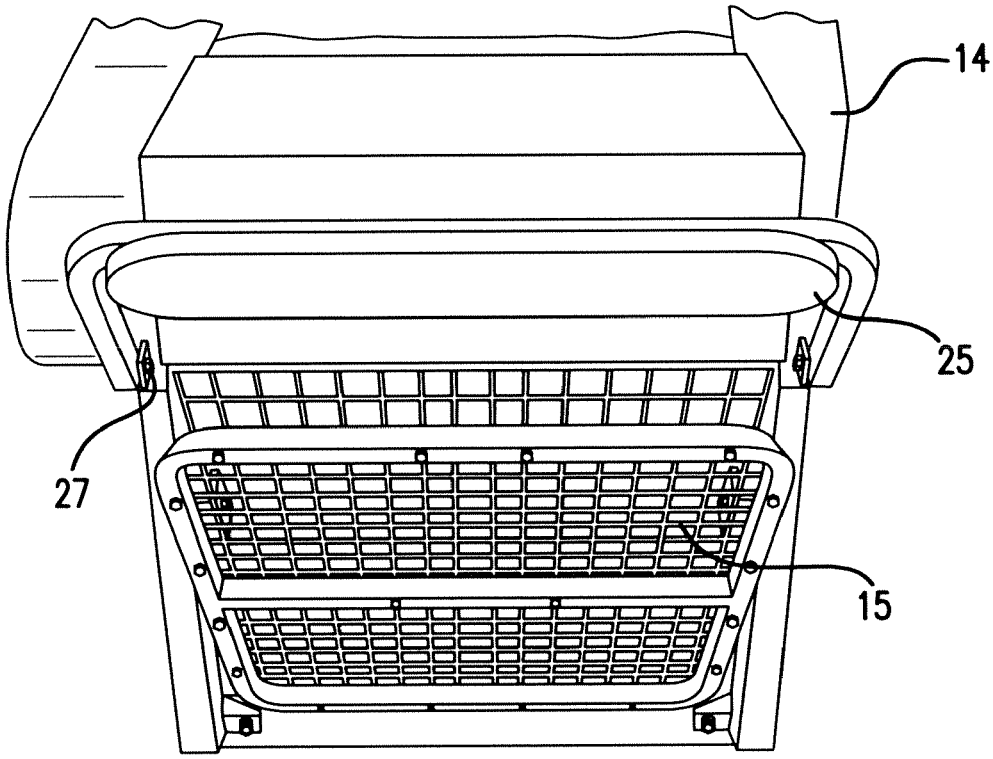
FIG. 9A is a bottom elevation view of an exemplary embodiment of a screen 15 and an exemplary embodiment of a magnet 25 mounted to an excavator bucket 14 in accordance with an exemplary embodiment of the present invention.
Figure 9B:
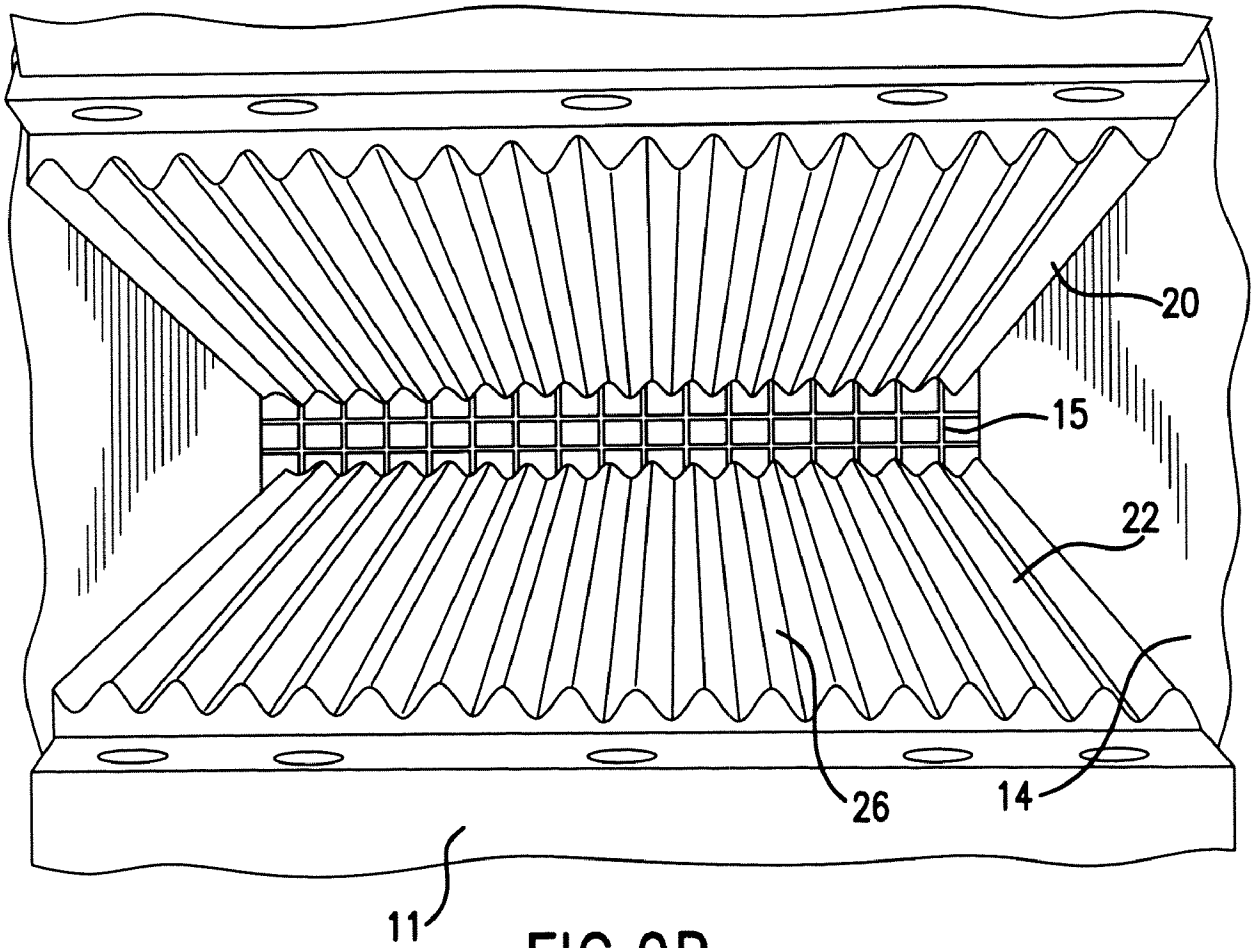
FIG. 9B is a top plan view looking down into the jaws of the crusher in the bucket and seeing the screen 15 beneath the outlet of the bucket.

As shown in FIG. 9A, the peripheral support for the screen 15 may include a steel structure, for instance tubular steel or angle iron. Moreover, the peripheral support can include a series of reinforcing members spanning between the rails that can define the outer carriage of the peripheral support, especially if the outer carriage is configured in a rectangular shape.

Figure 3:
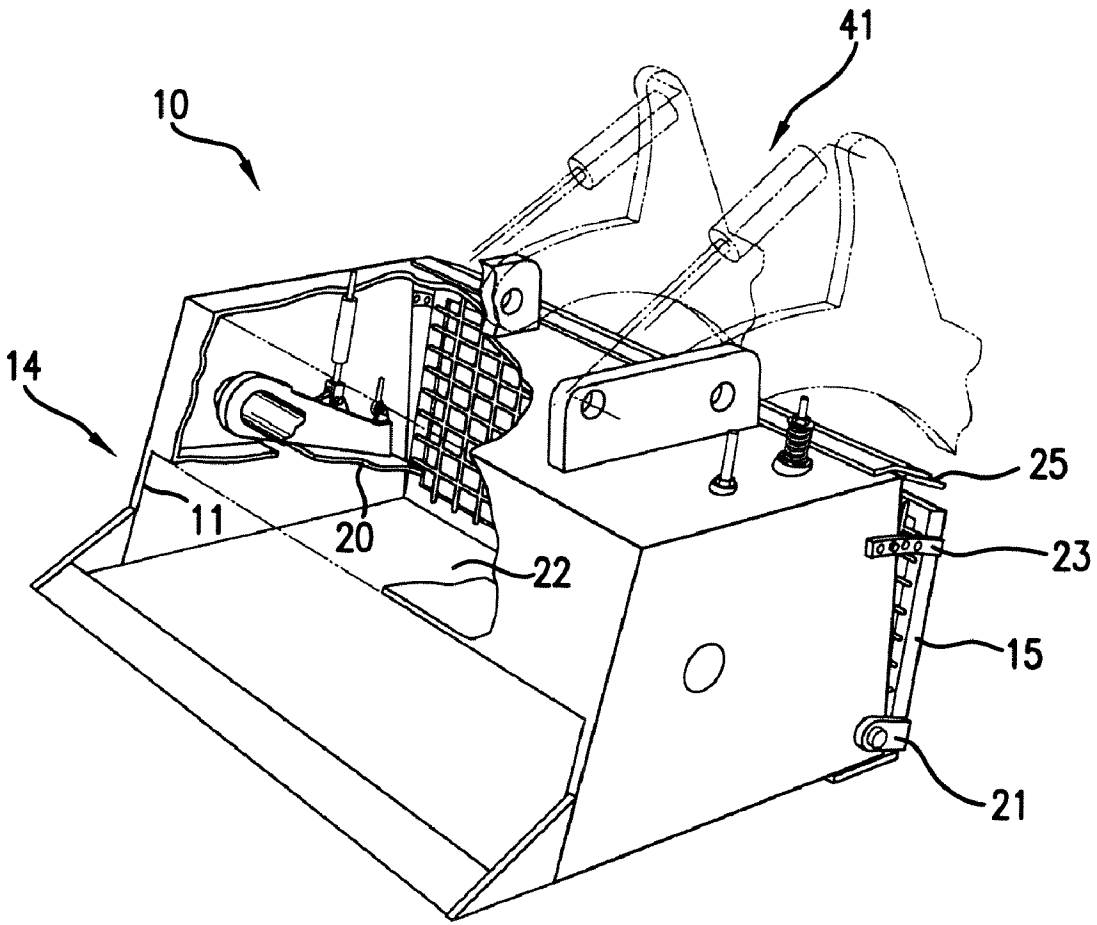
FIG. 3 is a side elevation view of an exemplary embodiment of a mobile front-end loader bucket 14 outfitted with a jaw crusher assembly and an embodiment of a screen 15 and an embodiment of a magnet 25 in accordance with the present invention with linkages to the front-end loader shown in chain-dashed line.

The position of the screen 15 relative to the outlet opening 12 of the bucket 14 can be effected in any of a number of ways, some of which being mentioned as follows. As shown in FIGS. 2-4 and 6A, exemplary embodiments of the mobile bucket assembly 10 connect the screen 15 to the bucket or frame 14 via a mechanism that includes a hinge 21 that is configured to allow the screen 15 to pivot with respect to the bucket 14. As shown in FIGS. 2 and 3, the orientation of the screen 15 relative to the outlet 12 of the bucket 14 can be static, i.e., selectively fixed, and can be set manually by an arm 23 that has one end fixed to the screen 15 and that has a plurality of spaced apart openings that receive therein a bolt or detent carried on the bucket 14.

Figure 9C:
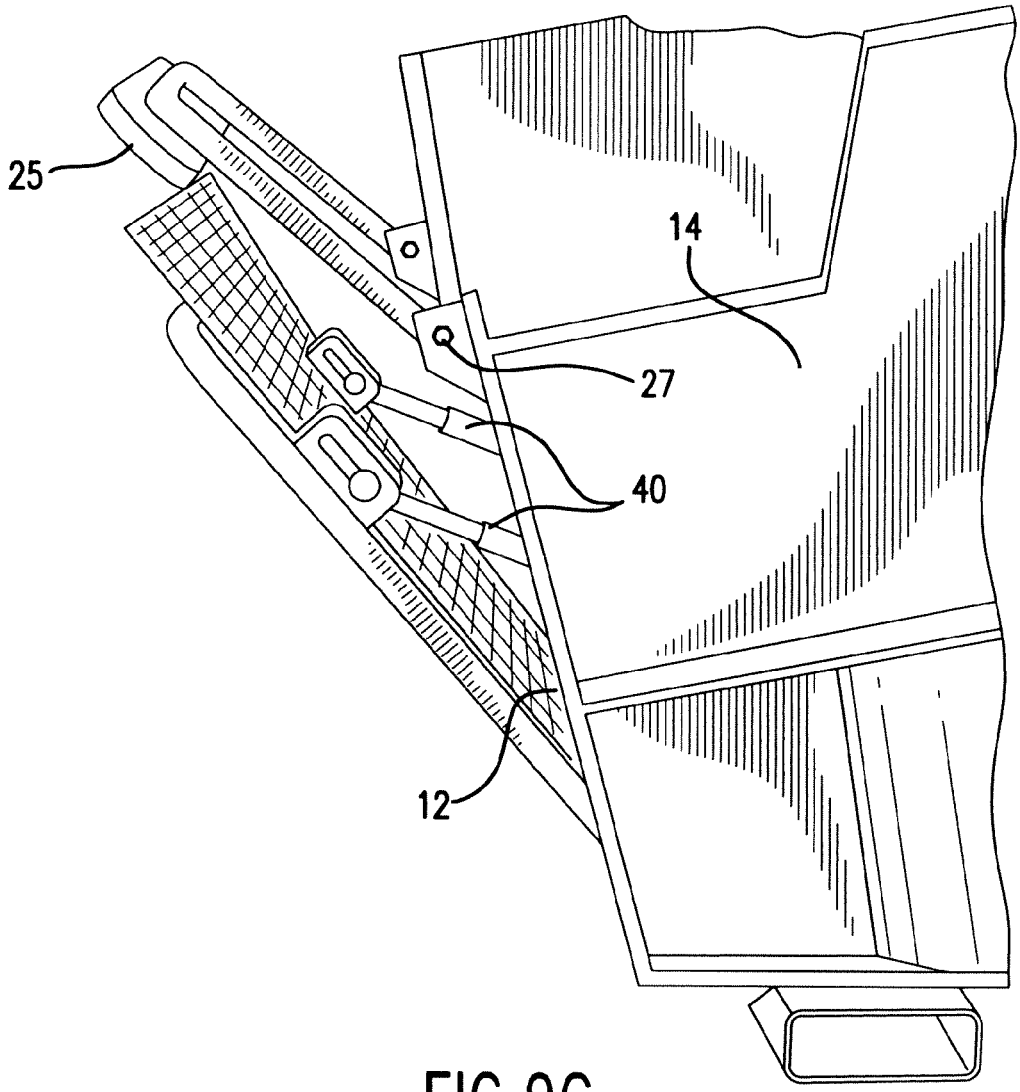
FIG. 9C is a side elevation view of the exemplary embodiments shown in FIG. 9A with the excavator bucket 14 positioned in the crushing orientation.
Figure 9D:
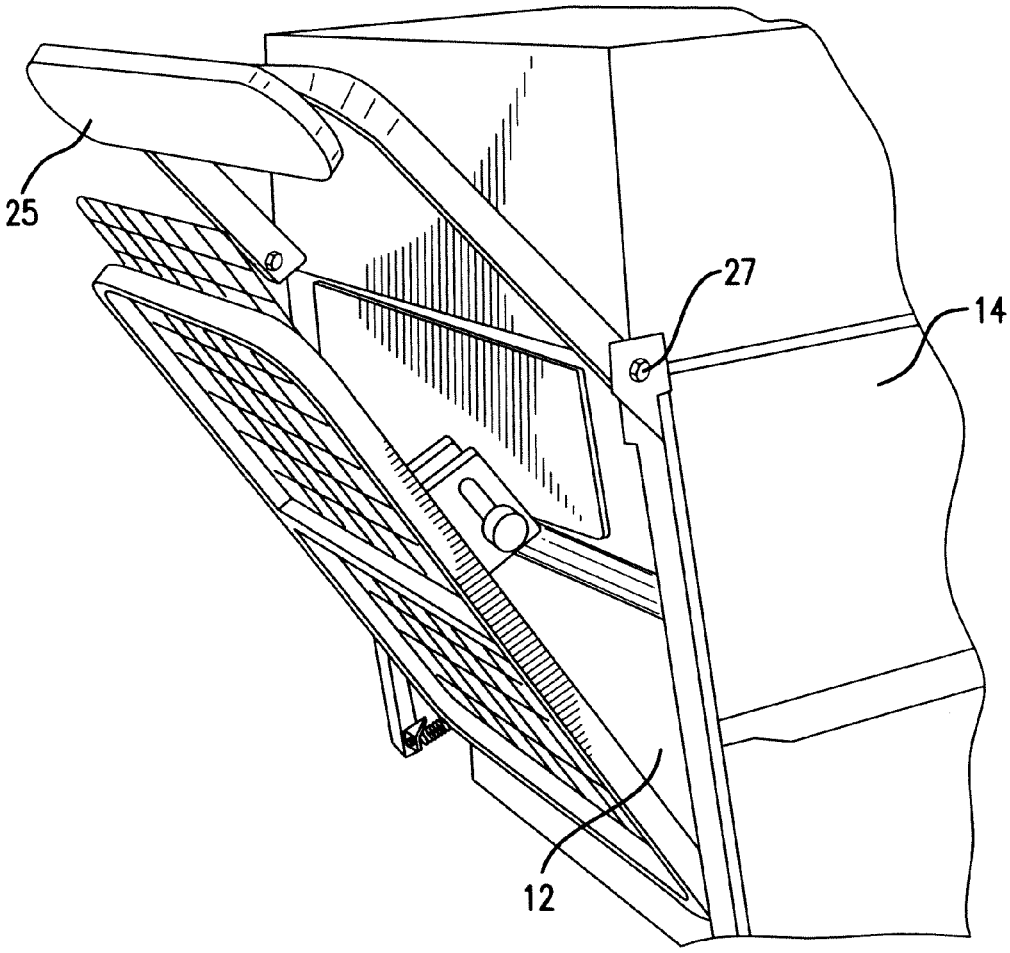
FIG. 9D is an elevation view of the embodiments in FIG. 9C but taken from a view that is more underneath the outlet of the excavator bucket 14.
Figure 9E:
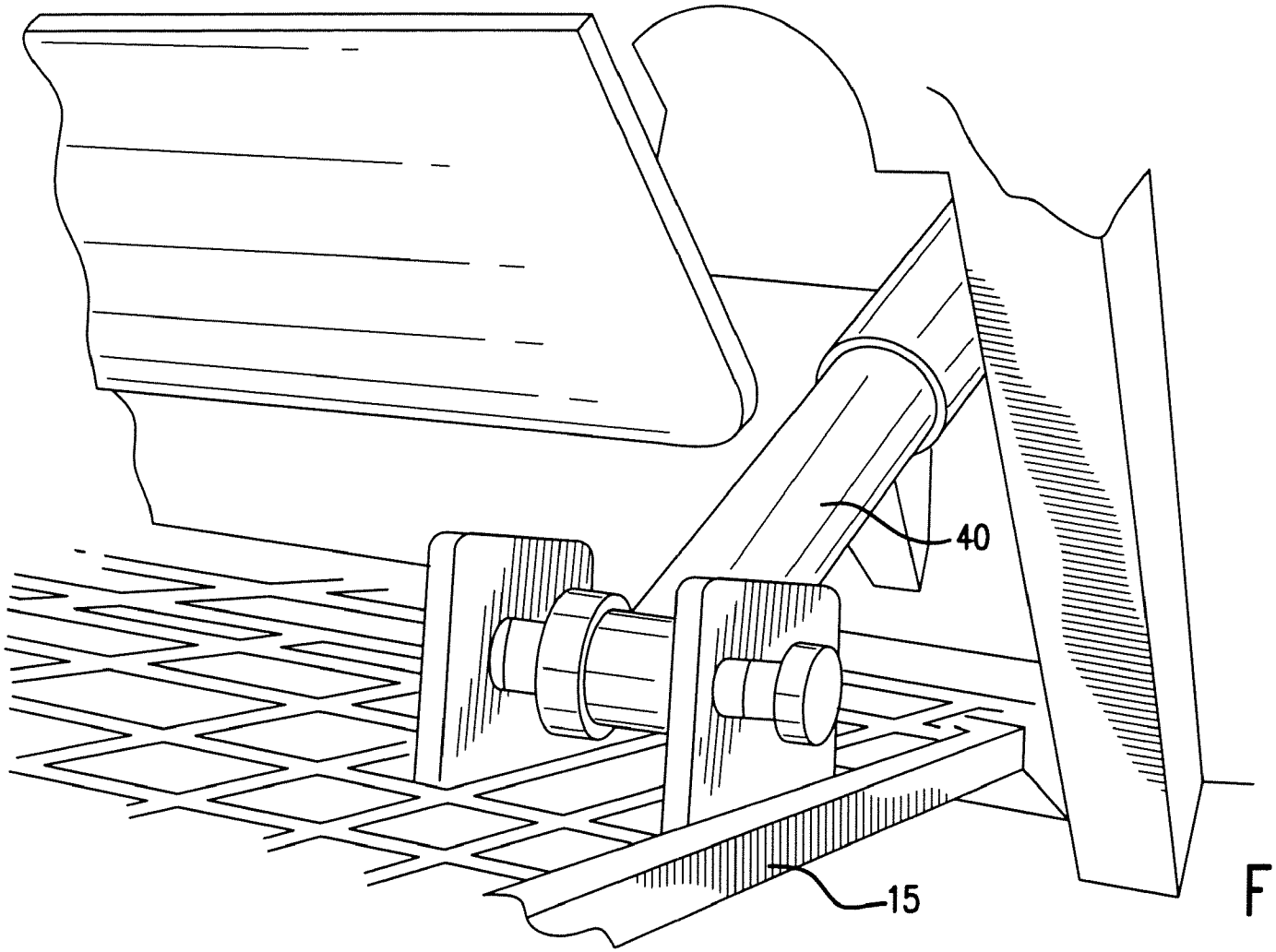
FIG. 9E is a close up perspective view of aspects of the embodiment in FIGS. 9A-9D but taken from a view that is more between the screen 15 and the outlet of the excavator bucket 14 and showing the pivotal linkage of the screen 15 to the moving jaw of the crusher.
Figure 9F:
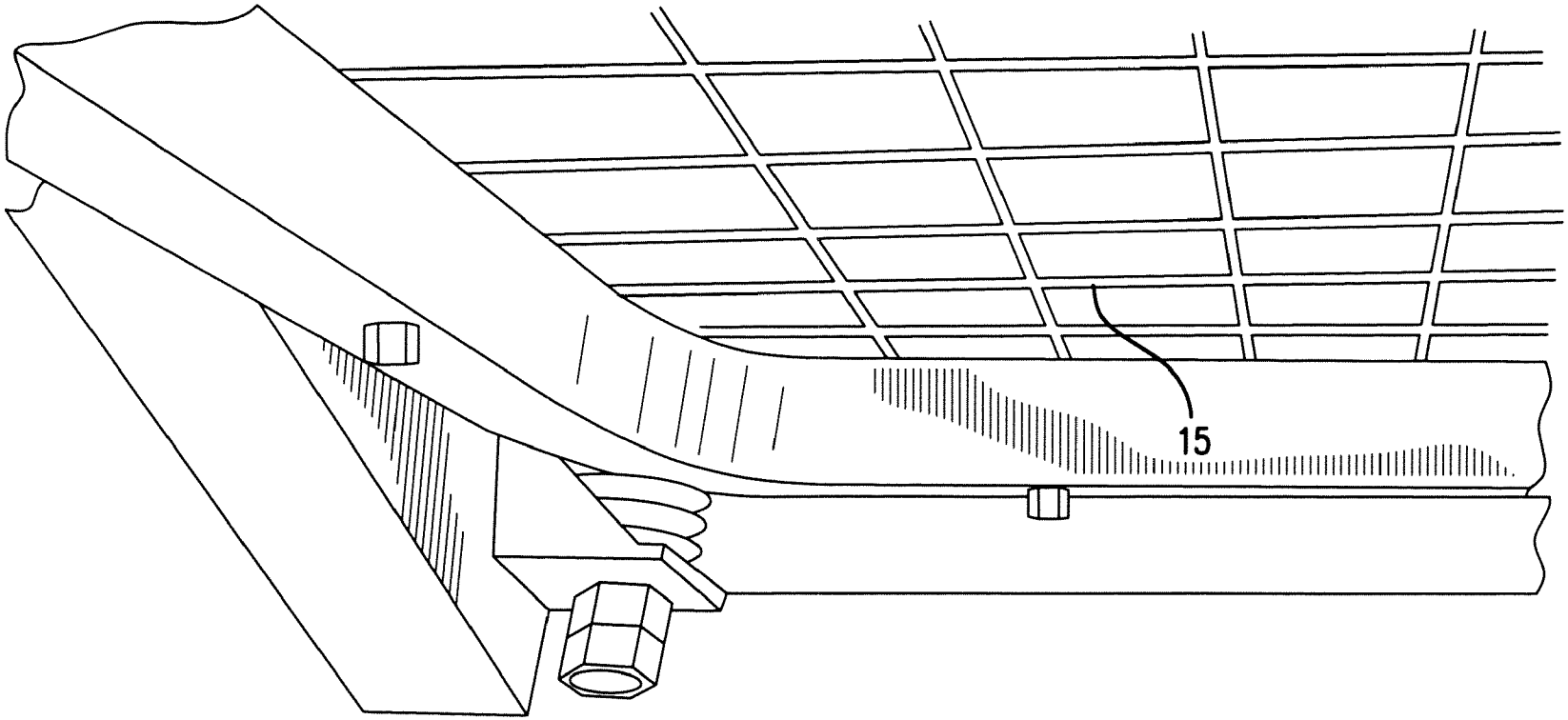
FIG. 9F is a close up perspective view of the spring-loaded mounting of the screen 15 of the embodiment shown in FIGS. 9A-9D but taken from a view that is more beneath the screen 15.

As schematically shown in FIG. 9E, the mobile bucket assembly 10 can include a hydraulic or pneumatic cylinder 40 that engages the screen 15 and can be used for positioning the screen 15 relative to the outlet 12 of the bucket 14. In the exemplary embodiment that is schematically shown in FIG. 9E, a hydraulic or pneumatic cylinder 40 has been substituted for one of the first rods 32 shown in FIGS. 1 and 7. The hydraulic or pneumatic cylinder 40 may be actuated such that the proper positioning of the screen 15 is maintained. While one hydraulic or pneumatic cylinder 40 is visible in the view shown in FIG. 9E, it is to be understood that another number of hydraulic or pneumatic cylinders 40 and/or the first rods 32 may be employed in other exemplary embodiments of the present invention. Additionally, the presence of the rods 32 along with the hydraulic or pneumatic cylinders 40 may not be necessary in other exemplary embodiments of the present invention.

The orientation of the screen 15 relative to the outlet 12 of the bucket 14 can be dynamic. For example, the exemplary embodiment of the mobile bucket assembly 10 shown in FIGS. 1 and 7 is shown having two first rods 32 being present, each having a spring 34 and a nut 36 thereon in order to help properly position the screen 15 relative to the outlet opening 12 of the bucket 14. The combination of the nut 36, attached to one end of rod 32, which passes through spring 34 can substitute for the hinge 21 and function in a manner similar to the hinge 21 shown in FIGS. 2-4 and 6A. As shown in FIGS. 9C and 9E, the mobile bucket assembly 10 can include at least one shock absorber 40 that has one end engaging the screen 15 and the opposite end pivotally connected to the bucket and that can adjust the distance between the screen 15 and the outlet 12 of the bucket.

In accordance with the present invention, the screen 15 also can be connected to a vibratory device that shakes the screen 15 in various motions, such as side-to-side, forward-to-back, up and down, eccentrically and any combination of the forgoing motions. As shown in FIG. 6D for example, the screen 15 can be pivotally connected to one end of a rod 33 that has an opposite end connected pivotally to the lower portion of the first crushing member 20. The opposite end of the screen 15 can be adjustably connected to the bucket 14 via a spring 28. When the first crushing member 20 moves during the crushing operation, the screen 15, which is connected to the rod 33 and spring 28, is thereby mechanically moved both vertically and horizontally, and thus shaken. The connection of the one end of the screen via the spring 28 further ensures that the mechanical shaking serves to cause the screen 15 to be vibrated as well. Alternatively, a shock absorber can be used in place of the rod 33 and/or the spring 28.

Figure 10:
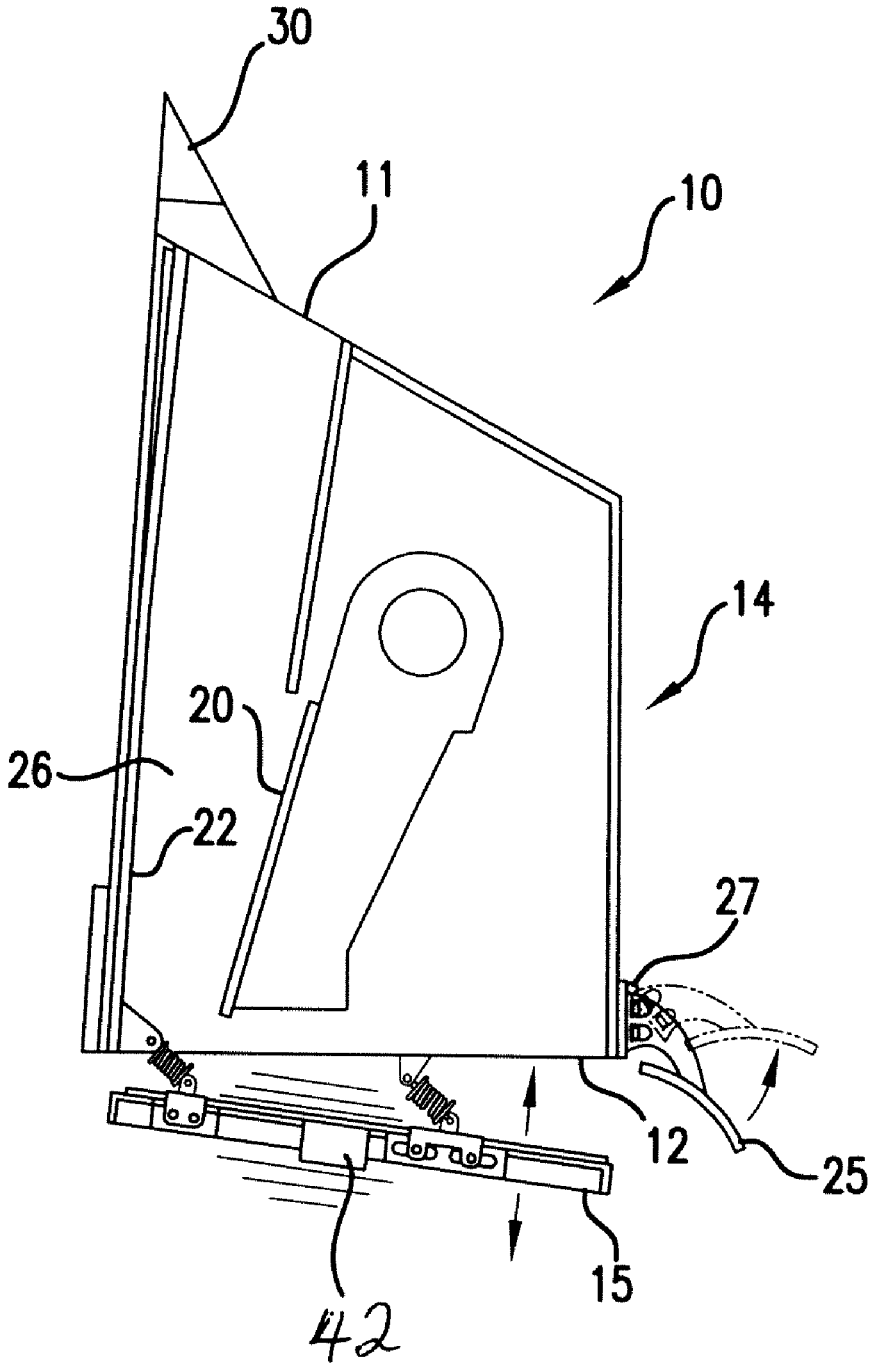
FIG. 10 is a side elevation view of the exemplary embodiments shown with the side removed to expose certain components internally of the bucket 14 and focusing on an embodiment with a vibrating screen.

As shown in FIG. 10 for example, the vibration of the screen 15 may be obtained through attachment of an hydraulic vibrator 42 to the screen 15 and particularly to the peripheral frame of the screen 15. Alternatively, an electric motor powered vibrator 42 can be substituted for the hydraulic vibrator 42. In each of these implementations, the screen 15 can be vibrated independently of the operation of the crushing assembly within the bucket 14.

Figure 11A:
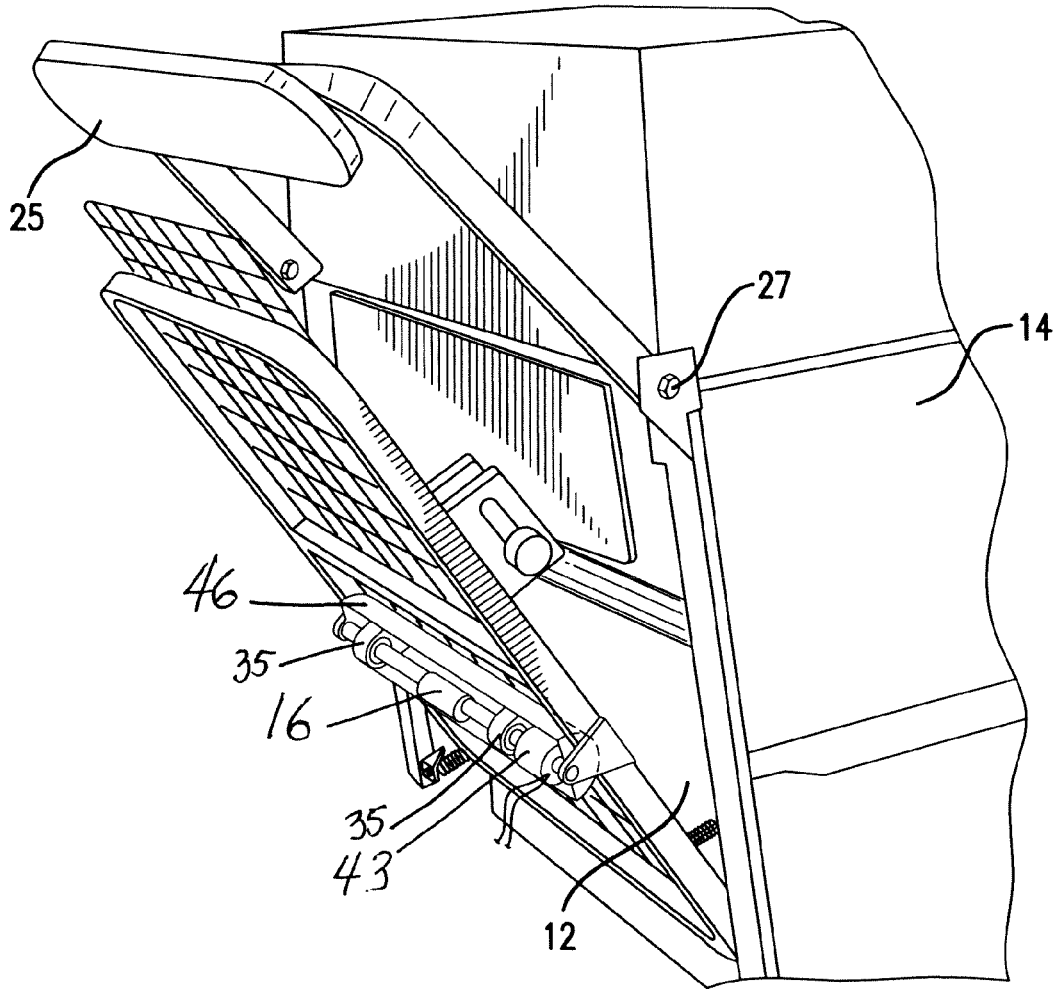
FIG. 11A is a side elevation view of the exemplary embodiments shown from underneath the outlet of the bucket 14 and focusing on an alternative embodiment with a vibrating screen.
Figure 11B:
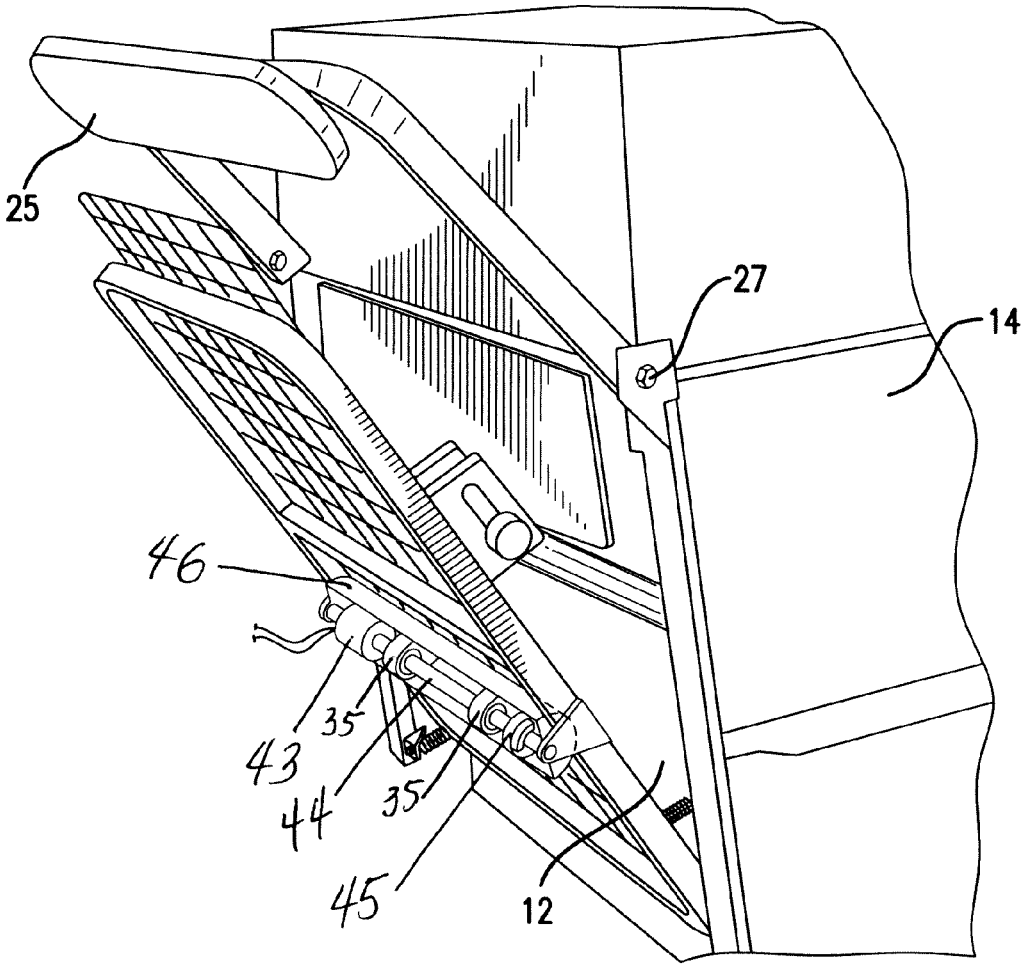
FIG. 11B is a side elevation view of the exemplary embodiments shown from underneath the outlet of the bucket 14 and focusing on another alternative embodiment with a vibrating screen.

As shown in FIGS. 6E and 11A for example, the vibration of the screen 15 may be obtained through an eccentric shaft 16 that may be rotated in bearings 35 by an electrical or hydraulic motor 43 (not visible in the view shown in FIG. 6E) mounted on one end thereof and shown in more detail in FIG. 11A. Alternatively, as shown in FIG. 11B for example, the vibration of the screen 15 may be obtained through a straight shaft 44 that may be rotated in bearings 35 by an electrical or hydraulic motor 43 (not shown in FIG. 6E) on one end thereof and that carries an asymmetrically weighted pulley 45 on the opposite end thereof. The shafts 16, 44 can be rotatably mounted in bearings 35 beneath the screen 15 and protected from becoming fouled by crushed debris by a rigid hood 46 disposed between the shaft 16, 44 and the underside of the screen 15.

The driving mechanisms for the screen's vibratory assembly can include a hydraulic motor 43 such as shown in FIGS. 11A and 11B or an electrical motor may be substituted therefor. If a hydraulic motor is used, the hydraulic motor may be powered by a hydraulic source of a diesel system and connected via a pressure line containing hydraulic fluid. A separate diesel/hydraulic power source may be provided on the frame 14 in order to run the hydraulic motor. Such an independent diesel/hydraulic source can be separate from a diesel and hydraulic system of the vehicle. It is also possible for the vibration of the screen 15 to be powered by the hydraulic source of the vehicle that carries the bucket 14. Additionally, the power source for either the electric motor or the hydraulic motor does not need to be provided by the vehicle. Referring back to FIGS. 6E 11A and 11B, additional ways of driving the eccentric shaft 16 and the straight shaft 44 are possible, as is known in the art, and the present invention is not limited to a particular mode of driving the eccentric shaft 16 or the straight shaft 44.

Figure 4:
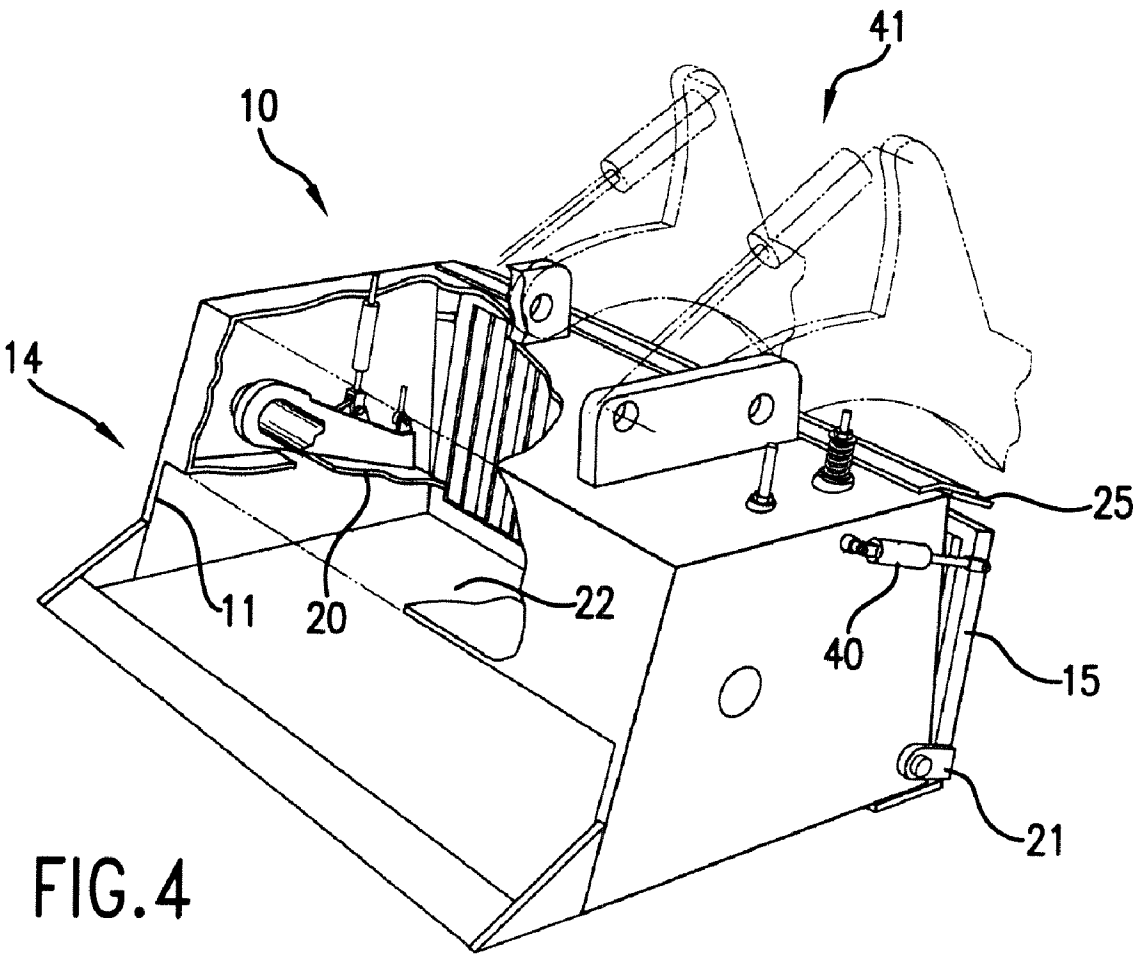
FIG. 4 is a side elevation view of another exemplary embodiment of a mobile front-end loader bucket 14 outfitted with a jaw crusher assembly and an embodiment of a screen 15 and an embodiment of a magnet 25 in accordance with the present invention with linkages to the front-end loader shown in chain-dashed line.

Protecting the screen from damage can be effected in any of a number of ways, some of which being mentioned above such as the use of shock absorbers and some being mentioned as follows. As shown in FIGS. 1, 6E and 7, exemplary embodiments of the mobile bucket assembly 10 can be provided in which the screen 15 can be attached to the bucket 14 via spring-loaded slide rods that are configured to allow the screen 15 to pivot with respect to the bucket 14 and retract against the bucket 15 when the bucket 14 is not in use and is rested against the screen 15 on the ground. As schematically shown in FIGS. 4 and 9E, other exemplary embodiments of the mobile bucket assembly 10 can attach the screen 15 to the bucket 14 via a piston rod disposed in a cylinder 40 that is filled with gas or hydraulic fluid and where such an arrangement is configured to allow the screen 15 to pivot with respect to the bucket 14 and retract against the bucket 15 when the bucket 14 is not in use and is rested against the screen 15 on the ground. As shown in FIG. 9C, the mobile bucket assembly 10 can include at least one shock absorber 40 that has one end engaging the screen 15 and the opposite end pivotally connected to the bucket and that can adjust the distance between the screen 15 and the outlet 12 of the bucket 14 if the bucket is rested with the screen 15 between the bucket 14 and the ground.

In accordance with the present invention and shown in FIGS. 1, 3-7, 9A, 9C, 9D and 12, the mobile bucket assembly 10 can include a magnet 25 carried by the frame/bucket 14 and configured to be selectively positioned to intercept objects exiting through the outlet 12 of the bucket 14. The magnet 25 thereby can remove from the flow of crushed material exiting through the outlet opening 12 of the bucket 14, objects that contain metal that is attracted to the magnet 25.

As shown in FIGS. 6E, 9A, 9C and 9D for example, the mobile bucket assembly 10 may be provided with a magnet 25 that can have a support member that is pivotally hinged to the bucket 14. In such embodiments, the hinge 27 can be configured to allow the magnet 25 to pivot with respect to the bucket 14 and thus retract when the bucket 14 is not in use and is rested against the ground.

The magnet 25 can be of any type, including but not limited to a permanent magnet or an electro-magnet. The magnet 25 can be provided with a device to render the magnet self-cleaning. For example, an electro-magnet 25 can be rendered a self-cleaning magnet by being selectively provided with electrical power when it is desired to remove metallic items from the discharge flow of material and depriving the electro-magnet of electrical power to de-magnetize same and release any metallic objects that were attracted to the magnet 25 from the material discharged from the bucket 14.

Figure 12:
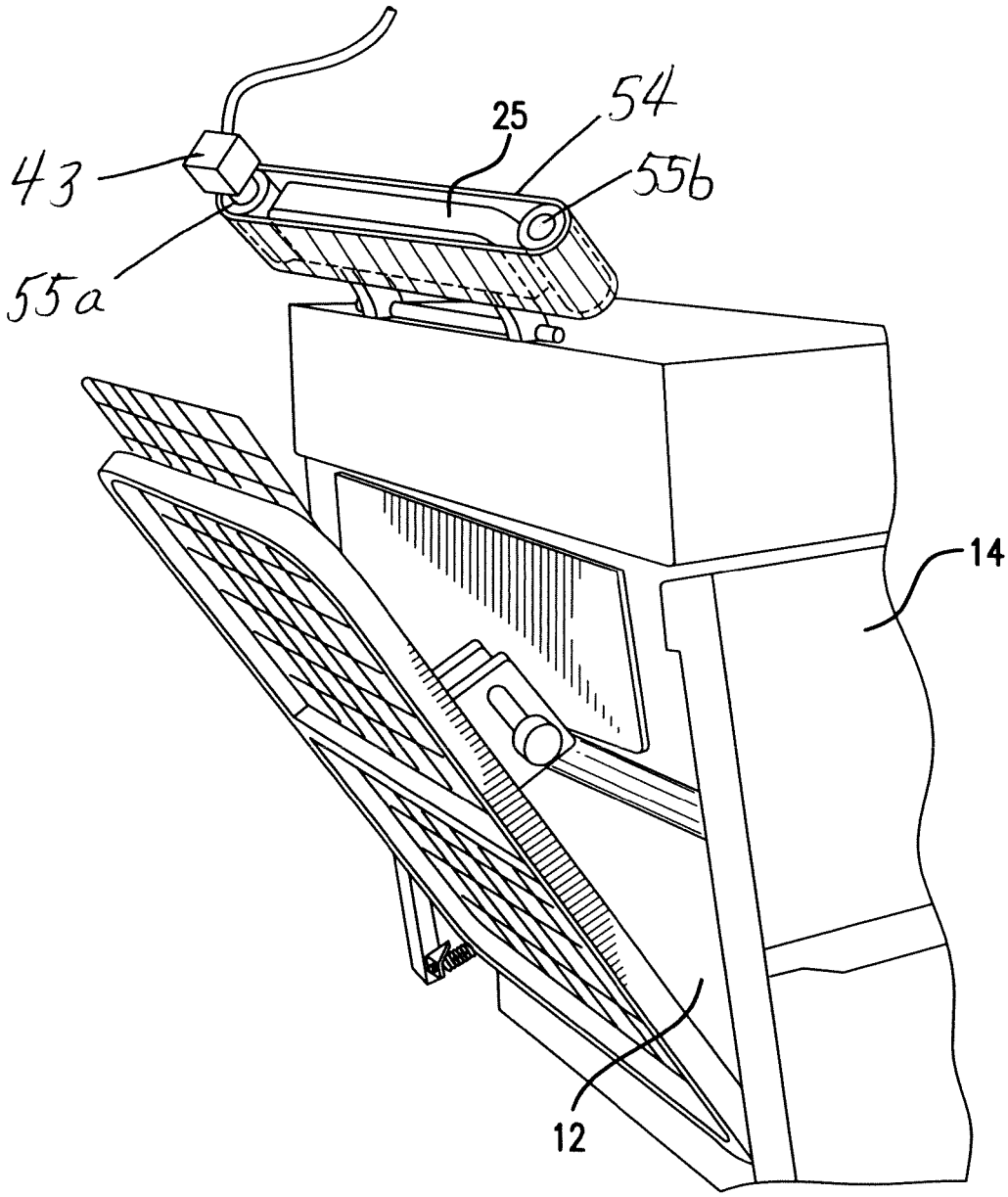
FIG. 12 is a side elevation view of the exemplary embodiments shown from underneath the outlet of the bucket 14 and focusing on an embodiment with a self-cleaning magnet.

Alternatively, either the permanent magnet or the electro-magnet may be rendered self-cleaning by being provided with a cleaner that removes the metallic objects that are caught by the magnet 25 and thereby removed from the flow of crushed material leaving the outlet 12 of the bucket 14. As schematically shown in FIG. 12 for example, one embodiment of the cleaner can include a continuous belt 54 that is driven around rollers 55*a*, 55*b* disposed at opposite ends of the magnet 25. The belt 54 can be disposed with the magnet 25 sandwiched between the rollers 55*a*, 55*b*, and one of the two lengthwise runs of the belt 54 can be disposed over the top of the magnet 25 while the opposed lengthwise run can be disposed beneath the bottom of the magnet 25. The inwardly facing surface of the belt 54 desirably can be provided with sweeping elements that continuously sweep across the magnet 25 as the belt 54 is driven and thereby sweep away debris that might become lodged in the spaces between the belt 54 and the magnet 25. Moreover, the belt 54 can be connected to the rollers 55*a*, 55*b* by a sprocket and gear arrangement.

The belt 54 desirably can be driven by an hydraulic motor 43 or a pneumatic motor or an electric motor. As shown in FIG. 12, the motor 43 can be connected to drive at least one of the rollers 55*a*. When the metallic debris is attracted to the magnet 25 through the belt 54, the moving belt 54 moves the debris toward one of the rollers 55*b*. As the belt 54 rounds the roller 55*b*, the debris feels less of the attractive force of the magnet 25 and the centripetal force generated as the debris starts to follow the belt 54 around the roller 55*b* tends to fling the metallic debris sideways away from the bucket 14.

The bucket 14 shown in FIG. 1 happens to be an excavator bucket and happens to include a jaw crusher within the bucket 14. However, the screen 15 and/or the magnet 25 can be used in connection with a front-end loader bucket 14, as is apparent from what is shown in FIGS. 2-4. Moreover, the screen 15 and/or the magnet 25 can be used in connection with a bucket 14 that includes an impact crusher, as is apparent from what is shown in FIG. 2, which illustrates an impact crusher mechanism.

The mobile bucket assembly 10 may be used in a variety of applications. For instance it may be used in the construction, demolition, recycling, aggregate, and or excavation industries. The mobile bucket assembly 10 may be provided as a retrofit unit to replace the bucket that typically is present on the front of a front-end loader or the end of the arm of an excavator. Alternatively, the mobile bucket assembly 10 may be sold as an integrated unit with the vehicle.

It should be understood that the present invention includes various modifications that can be made to the exemplary embodiments of the mobile bucket assembly 10 described herein as come within the scope of the appended claims and their equivalents.

What is claimed is:

1. A mobile bucket assembly for crushing objects, comprising:

a frame defining a bucket having an inlet and an outlet and a crushing chamber disposed between said inlet and said outlet, the frame being configured for attachment to a vehicle capable of moving said mobile bucket assembly;

a crushing assembly carried by said frame and including a crushing element disposed within said crushing chamber of said bucket, said crushing element being configured for disintegrating material in the form of demolition debris, aggregate, stone and/or steel objects, said crushing element being configured to be selectively moveable to crush the material while in said crushing chamber after entering through said inlet of said bucket;

a screen carried by said frame at a position that is separated from said crushing chamber where the material is being disintegrated by said crushing element and said screen configured to be selectively positioned to intercept objects from the crushed material exiting said bucket through said outlet of said bucket;

a magnet carried by said frame and configured to be selectively positioned to intercept objects exiting said bucket through said outlet of said bucket; and a cleaning assembly connected to said magnet and configured to selectively remove debris from said magnet.

2. The mobile bucket assembly of claim 1, wherein said screen has a hinge configured to allow said screen to pivot with respect to the bucket.

3. The mobile bucket assembly of claim 2, wherein the orientation of said screen relative to the outlet of the bucket is selectively fixed and can be set manually by an arm that has a plurality of spaced apart openings that receive therein one of a detent and a bolt.

4. The mobile bucket assembly of claim 1, wherein the orientation of said screen relative to the outlet of the bucket is selectively fixed and can be set by one of a pneumatic cylinder and a hydraulic cylinder.

5. The mobile bucket assembly of claim 1, wherein the screen is carried by said frame in a manner configured to allow the screen to pivot with respect to the bucket and retract against the bucket when the bucket is not in use and is rested against the screen on the ground.

6. The mobile bucket assembly of claim 1, wherein said screen is configured and disposed to define at least two distinct pathways, wherein one of the pathways separates from the incoming mass materials having a first size profile and the other pathway permits passage of materials that did not become separated via the one pathway.

7. The mobile bucket assembly of claim 1, wherein said crushing assembly is a jaw crusher assembly.

8. The mobile bucket assembly of claim 1, wherein said crushing assembly is an impact crusher assembly.

9. The mobile bucket assembly of claim 1, further comprising:

a vibratory assembly connected to said screen and configured to selectively cause said screen to vibrate.

10. The mobile bucket assembly of claim 9, wherein the vibratory assembly includes an hydraulic vibrator.

11. The mobile bucket assembly of claim 9, wherein the vibratory assembly includes an eccentric shaft.

12. The mobile bucket assembly of claim 9, wherein the vibratory assembly includes a shaft and an asymmetrically weighted pulley connected to said shaft.

13. The mobile bucket assembly of claim 12, wherein the vibratory assembly includes an hydraulic motor connected to drive said shaft.

14. The mobile bucket assembly of claim 1, wherein the cleaning assembly includes a pair of opposed rollers and a continuous belt driven around said rollers.

15. The mobile bucket assembly of claim 1, further comprising: an excavator connected to said bucket.

16. The mobile bucket assembly of claim 1, further comprising: a front-end loader connected to said bucket.

* * * * *